US008630745B2

(12) United States Patent
Noda et al.

(10) Patent No.: US 8,630,745 B2
(45) Date of Patent: Jan. 14, 2014

(54) ENERGY CONSUMPTION MANAGEMENT SYSTEM AND ENERGY CONSUMPTION MANAGEMENT APPARATUS

(75) Inventors: Shuhei Noda, Fuchu (JP); Kenji Baba, Kodaira (JP); Takaaki Enohara, Hino (JP); Kazumi Nagata, Fuchu (JP); Nobutaka Nishimura, Koganei (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 189 days.

(21) Appl. No.: 13/186,014

(22) Filed: Jul. 19, 2011

(65) Prior Publication Data

US 2012/0022710 A1 Jan. 26, 2012

(30) Foreign Application Priority Data

Jul. 21, 2010 (JP) ..... P2010-163672

(51) Int. Cl.
*G05B 13/00* (2006.01)

(52) U.S. Cl.
USPC ..... 700/295; 702/62; 361/62

(58) Field of Classification Search
USPC ..... 700/295; 702/62; 361/62
See application file for complete search history.

(56) References Cited

U.S. PATENT DOCUMENTS

| | | | | |
|---|---|---|---|---|
| 7,386,421 | B2 * | 6/2008 | Miki | 702/183 |
| 7,734,441 | B2 * | 6/2010 | Taravat et al. | 702/100 |
| 2006/0248359 | A1 * | 11/2006 | Fung | 713/300 |
| 2008/0307240 | A1 * | 12/2008 | Dahan et al. | 713/320 |
| 2009/0222682 | A1 * | 9/2009 | Piper et al. | 713/340 |
| 2009/0228726 | A1 * | 9/2009 | Malik et al. | 713/320 |
| 2010/0023176 | A1 * | 1/2010 | Imagawa et al. | 700/295 |
| 2010/0204540 | A1 * | 8/2010 | Oohashi et al. | 600/27 |
| 2010/0332373 | A1 * | 12/2010 | Crabtree et al. | 705/37 |
| 2011/0034300 | A1 * | 2/2011 | Hall | 482/1 |

FOREIGN PATENT DOCUMENTS

| | | |
|---|---|---|
| CN | 101051223 | 10/2007 |
| CN | 101173813 | 5/2008 |
| CN | 201318766 | 9/2009 |
| CN | 101561168 | 10/2009 |
| CN | 101738975 | 6/2010 |
| JP | 2001-91034 | 4/2001 |
| JP | 2003-134695 | 5/2003 |
| JP | 2004-108698 | 4/2004 |
| JP | 2005-180756 | 7/2005 |
| JP | 2006-292279 | 10/2006 |
| JP | 2007-120861 | 5/2007 |
| JP | 2009-30818 | 2/2009 |
| JP | 2009-92267 | 4/2009 |
| JP | 2009-245361 | 10/2009 |
| JP | 2009-299933 | 12/2009 |

OTHER PUBLICATIONS

Notification of Reasons for Refusal issued by the Japanese Patent Office on Apr. 24, 2012, for Japanese Patent Application No. 2010-163672, and English-language translation thereof.

Baba et al., U.S. Appl. No. 13/184,793, filed Jul. 18, 2011.

Decision of Rejection issued by the Japanese Patent Office Nov. 13, 2012, for Japanese Patent Application No. 2010-163672, and English-language translation thereof.

Takaaki Enohara et al.; "Air Conditioning Control System and Air Conditioning Control Method", U.S. Appl. No. 12/874,309, filed Sep. 2, 2010.

Kazumi Nagata et al.; "Image Processing Apparatus, Image Processing Method, and Air Conditioning Control Apparatus", U.S. Appl. No. 12/877,685, filed Sep. 8, 2010.

Examiner's Answer issued by the Japanese Patent Office May 28, 2013, for Japanese Patent Application No. 2010-163672, and English-language translation thereof.

Notification of First Examination Statement issued by the State Intellectual Property Office of the People's Republic of China on Jul. 18, 2013, for Chinese Patent Application No. 201110202250, and English-language translation thereof.

* cited by examiner

*Primary Examiner* — Mohammad Ali
*Assistant Examiner* — Anthony Whittington
(74) *Attorney, Agent, or Firm* — Finnegan, Henderson, Farabow, Garrett & Dunner, L.L.P.

(57) ABSTRACT

According to one embodiment, an energy consumption management system includes: a movement information creating device; a power consumption amount measuring device; an accumulating device; and a display device. The movement information creating device creates movement information regarding a person in a management target area. The power consumption amount measuring device measures a power consumption amount of an instrument in the management target area. The accumulating device creates management information in which the movement information and a power consumption amount measurement value measured are associated with each other. The display device displays the management information.

10 Claims, 8 Drawing Sheets

| | NUMBER OF PEOPLE | ACTIVITY AMOUNT | POWER CONSUMPTION AMOUNT | POWER CONSUMPTION AMOUNT PER PERSON |
|---|---|---|---|---|
| ROOM A | 15 | 2met | 10kW | 0.7kW |
| ROOM B | 1 | 1met | 9kW | 9.0kW |
| ROOM C | 7 | 2met | 11kW | 1.6kW |

| | NUMBER OF PEOPLE | ACTIVITY AMOUNT | POWER CONSUMPTION AMOUNT | OPENING DEGREE OF BLIND | POWER CONSUMPTION AMOUNT PER PERSON |
|---|---|---|---|---|---|
| ROOM A | 15 | 2met | 10kW | 0% | 0.7kW |
| ROOM B | 1 | 1met | 9kW | 80% | 9.0kW |
| ROOM C | 7 | 2met | 11kW | 100% | 1.6kW |

ENERGY CONSUMPTION MANAGEMENT SYSTEM AND ENERGY CONSUMPTION MANAGEMENT APPARATUS

CROSS REFERENCE TO RELATED APPLICATIONS AND INCORPORATED BY REFERENCE

The application is based upon and claims the benefit of priority from Japanese Patent Applications No. P2010-163672, filed on Jul. 21, 2010; the entire contents of which are incorporated herein by reference.

FIELD

Embodiments described herein relate generally to an energy consumption management system and an energy consumption management apparatus.

BACKGROUND

In order to address environmental problems such as global warming, which has been attracting attention in recent years, large facilities including office buildings and commercial facilities are required to operate with less power consumption.

About 50% of energy consumed by such large facilities is used by air conditioning equipment. Accordingly, a reduction of the energy consumed by air conditioning equipment is important as an anti-global warming measure.

In this connection, there has been provided a system, which comprehensively manages a power consumption amount consumed by the air conditioning equipment in such a building, thereby outputting advice information for reducing a power consumption amount of each of air conditioners, and controls such a power consumption amount so as not to exceed a preset target value, thereby performing measures for the energy saving.

However, in the conventional system as mentioned above, for example, even in an area such as a conference room where the number of persons who are present therein and action contents thereof are changed in a state of flux, the power consumption amount is evaluated in an unchanged manner irrespective of the changes of the number of persons and the action contents thereof. Accordingly, for example, in the case where it is necessary to raise an air conditioning level since the number of persons is large, the case where the air conditioning control is unnecessary since there are no persons present in the room, and so on, there has been a problem that energy management made by suitable control cannot be performed.

DETAILED DESCRIPTION

According to one embodiment, an energy consumption management system includes: a movement information creating device; a power consumption amount measuring device; an accumulating device; and a display device. The movement information creating device creates movement information regarding a person in a management target area at a predetermined time interval. The power consumption amount measuring device measures a power consumption amount of an instrument in the management target area at a predetermined time interval. The accumulating device creates management information in which the movement information created by the movement information creating device and a power consumption amount measurement value measured by the power consumption amount measuring device are associated with each other. The display device displays the management information created by the accumulating device.

Various Embodiments will be described hereinafter with reference to the accompanying drawings.

(First Embodiment)

<Configuration of Energy Consumption Management System According to First Embodiment>

Figure 1:
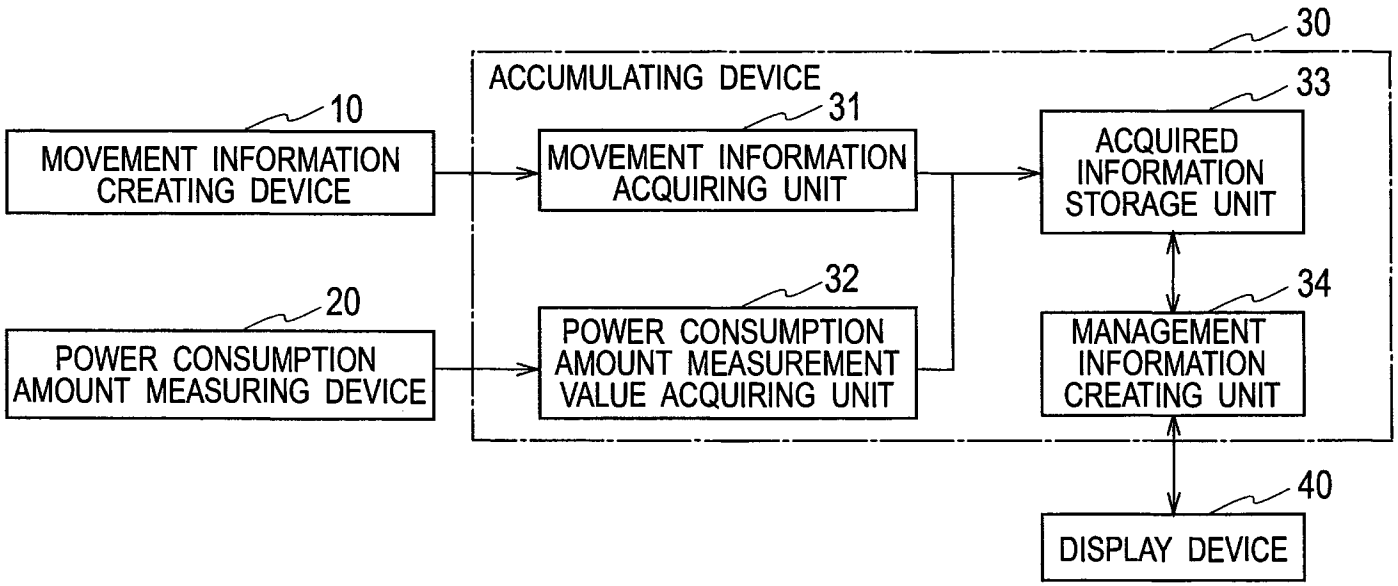
FIG. 1 is a block diagram showing a configuration of an energy consumption management system according to first and second embodiments.

A description is made of a configuration of an energy consumption management system according to a first embodiment of the present invention with reference to FIG. 1.

The energy consumption management system according to this embodiment includes: a movement information creating device 10 that creates movement information regarding persons present in a room; a power consumption amount measuring device 20 that measures a power consumption amount of an air conditioner; an accumulating device 30 that accumulates the movement information created by the movement information creating device 10 and the power consumption amount measured by the power consumption amount measuring device 20 and creates management information; and a display device 40 that displays the created management information.

The movement information creating device 10 creates movement information regarding persons in a room as a management target area at a predetermined time interval by using a motion sensor which uses an infrared ray, a camera device or the like. For example, the movement information creating device 10 creates information as to whether there are persons in the room, and information regarding the number of persons in the room, an activity amount thereof and the like, in the case where there are persons in the room. This "predetermined time interval" is a time interval at which it is possible to recognize a change or the like of the number of persons in the room as the management target area, or the like. For example, the "predetermined time interval" is a 1-minute interval.

Here, in the case where the information regarding the number of persons in the room, the activity amount thereof and the like is created, for example, the information concerned is created from image information regarding the management target area imaged by the camera device.

The power consumption amount measuring device 20 is a device that measures, at a predetermined time interval, a power consumption amount of an instrument in the management target area, for example, the air conditioner therein. The power consumption amount measuring device 20 may be composed of a power consumption amount meter built in the instrument concerned, or of a device that acquires the power consumption amount from an electric energy meter of the management target area or by analyzing an image obtained by imaging a display panel of the electric energy meter by means of a camera. This "predetermined time interval" is a time interval at which it is possible to recognize a change of the power consumption amount, and for example, is a 1-minute interval.

The accumulating device 30 includes: a movement information acquiring unit 31; a power consumption amount measurement value acquiring unit 32; an acquired information storage unit 33; and a management information creating unit 34.

The movement information acquiring unit 31 acquires the movement information regarding the persons in the room as the management target area, which is created by the movement information creating device 10.

The power consumption amount measurement value acquiring unit 32 acquires a power consumption amount measurement value of the instrument in the management target area, which is measured by the power consumption amount measuring device 20.

The acquired information storage unit 33 individually stores, together with time information, the movement information acquired by the movement information acquiring unit 31 and the power consumption amount measurement value acquired by the power consumption amount measurement value acquiring unit 32.

Based on information regarding a display target area and a display target period, which are set by a user of the system, the management information creating unit 34 extracts the corresponding movement information and power consumption amount measurement value from the acquired information storage unit 33, and creates management information, in which the movement information and the power consumption amount measurement value are associated with each other, at a predetermined time interval (for example, 1-minute interval, 30-minutes interval).

The display device 40 displays the management information created by the management information creating unit 34, and provides information for allowing such a system user to perform an energy saving control operation.

Figure 2:
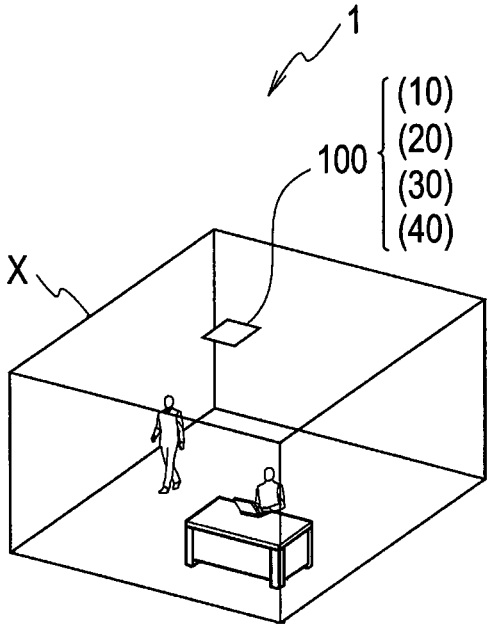
FIG. 2 is an overall view showing a configuration example (1) of the energy consumption management system according to the first embodiment.
Figure 3:
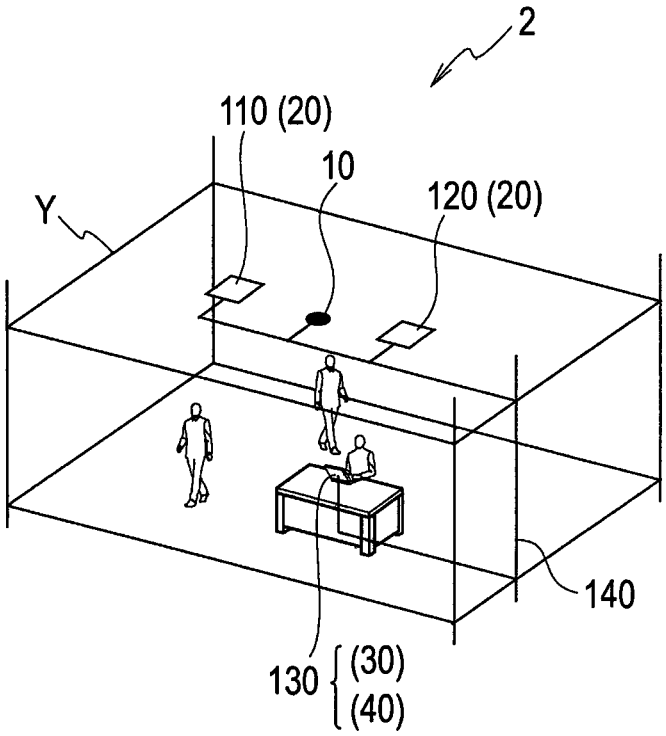
FIG. 3 is an overall view showing a configuration example (2) of the energy consumption management system according to the first embodiment.
Figure 4:
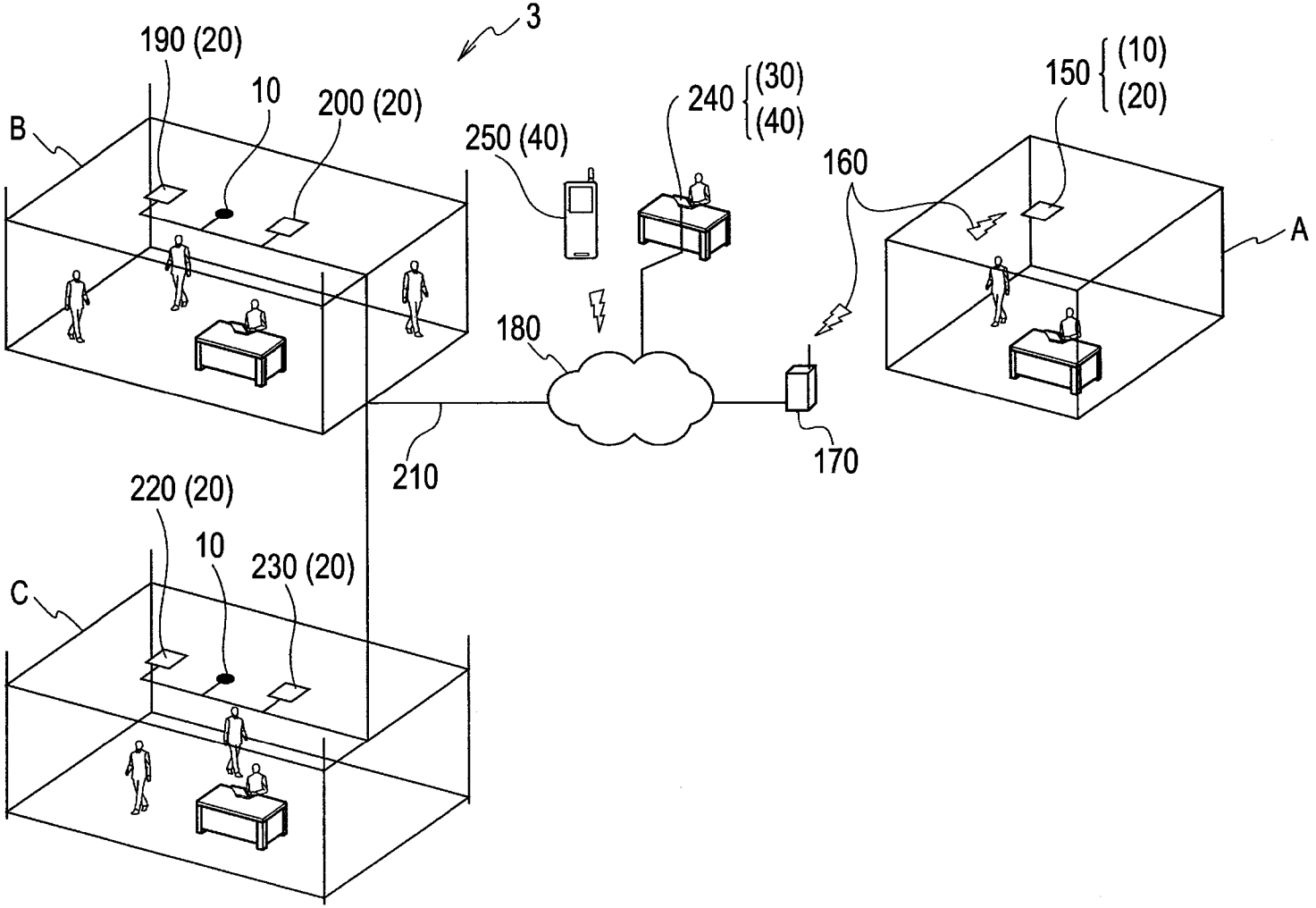
FIG. 4 is an overall view showing a configuration example (3) of the energy consumption management system according to the first embodiment.

The above-mentioned energy consumption management system is used by being configured, for example, as shown in FIG. 2 to FIG. 4.

FIG. 2 is an overall view of an energy consumption management system 1 in the case where the management target area is a room X which is single. An air conditioner 100 is installed in this room X, and on this air conditioner 100, there are mounted functions of the movement information creating device 10, the power consumption amount measuring device 20, the accumulating device 30 and the display device 40.

Moreover, FIG. 3 is an overall view of an energy consumption management system 2 in the case where the management target area is a room Y which is single. In this room Y, the movement information creating device 10, two air conditioners 110 and 120 and one personal computer (PC) 130 are connected to one another by dedicated transmission line 140. The function of the power consumption amount measuring device 20 is mounted on each of the air conditioners 110 and 120, and the functions of the accumulating device 30 and the display device 40 are mounted on the PC 130.

Moreover, FIG. 4 is an overall view of an energy consumption management system 3 in the case where the management target area is three, which are a room A, a room 13, and a room C. In this room A, an air conditioner 150 is installed, and this air conditioner 150 is connected to the Internet 180 through a wireless network 160 and a wireless base station 170. On this air conditioner 150, there are mounted the functions of the movement information creating device 10 and the power consumption amount measuring device 20.

Moreover, in the room B, the movement information creating device 10 which is single and two air conditioners 190 and 200 are connected to the Internet 180 through a wired network 210. On each of the air conditioners 190 and 200, the function of the power consumption amount measuring device 20 is mounted.

Moreover, in the room C, the movement information creating device 10 which is single and two air conditioners 220 and 230 are installed by being connected to the Internet 180 through the wired network 210. On each of the air conditioners 190 and 200, the function of the power consumption amount measuring device 20 is mounted. Moreover, a center management apparatus 240 is installed, which is connected through the Internet 180 to the air conditioner 150 in the room A, the movement information creating device 10, the air conditioner 190 and the air conditioner 200 in the room B, and the movement information creating device 10, the air conditioner 220 and the air conditioner 230 in the room C. On the center management apparatus 240, the functions of the accumulating device 30 and the display device 40 are mounted.

Furthermore, in the energy consumption management system 3, a portable terminal 250 carried by the system user may be composed in a connectable state to the Internet 180, and may be allowed to function as the display device 40 that displays management information created by the accumulating device 30 of the center management apparatus 240.

<Operations of Energy Consumption Management Systems According to First Embodiment>

A description is made of operations of the energy consumption management systems 1 to 3 according to this embodiment.

[Operations of Energy Consumption Management System 1]

Figure 5:
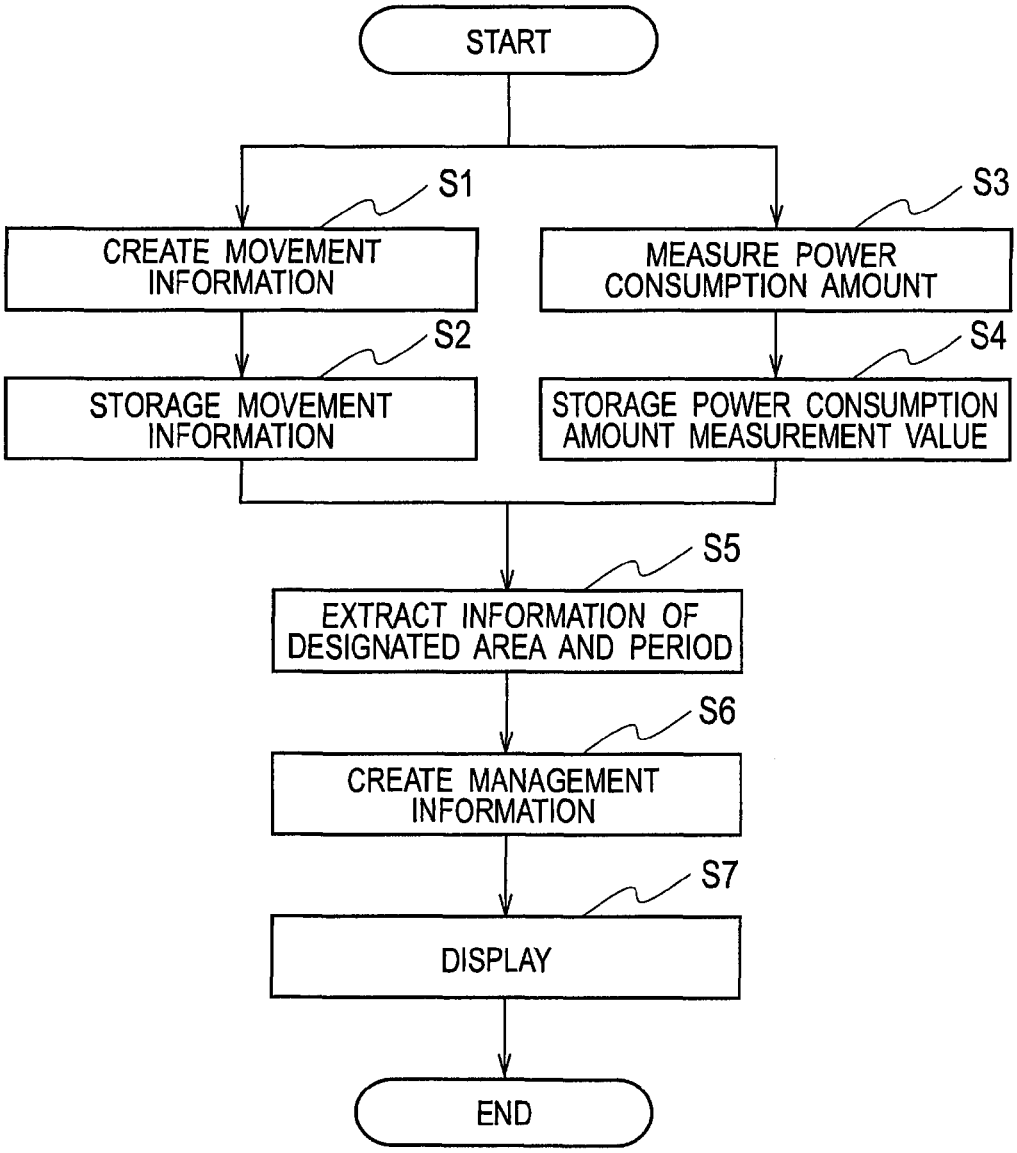
FIG. 5 is a flowchart showing an operation in the configuration example (1) of the energy consumption management system according to the first embodiment.

A description is made of operations of the air conditioner 100, which are performed when energy consumption management processing is executed in the energy consumption management system 1 shown in FIG. 2, with reference to a flowchart of FIG. 5.

First, the movement information regarding the persons present in the room X by the movement information creating device 10 built in the air conditioner 100 is created at a predetermined time interval (S1), is then acquired by the movement information acquiring unit 31 of the accumulating device 30, and is stored in the acquired information storage unit 33 (S2). In addition, the power consumption amount measurement value of the air conditioner 100 concerned is acquired at a predetermined time interval by the power consumption amount measuring device 20 (S3), and the power consumption amount measurement value acquired by the power consumption amount measurement value acquiring unit 32 of the accumulating device 30 is stored in the acquired information storage unit 33 (S4).

Here, the movement information created by the movement information creating device 10 is created from the measured number of persons present in the room and the measured activity amount thereof in such a manner that image information imaged by a camera device (not shown) installed in a state of being capable of imaging an inside of the room X.

With regard to the activity amount of the persons present in the room, the number of persons is counted for each activity amount value (met), each of which is preset for each of the activity contents, for example, for each of an activity amount "1.0 met" of an action of "being seated"; an activity amount "1.5 met" of an action of "standing", and an activity amount "2.0 met" of an action of "walking". Based on a result of such counting, for example, the activity amount of the maximum number of persons is decided as an activity amount of the persons present in the room in the area concerned.

Then, based on the information regarding the set display target area (here, the room X) and display target period, the movement information and the power consumption amount measurement value, which correspond to the area concerned and the period concerned, are extracted from the acquired information storage unit 33 (S5), and the management information, in which the movement information and the power consumption amount measurement value, both being accumulated at a predetermined time interval, are associated with each other, is created in the management information creating unit 34 (S6).

Then, the management information created in the management information creating unit 34 is displayed on the display device 40 (S7).

As described above, the display device 40 built in the air conditioner 100 in the management target area is allowed to display the management information during a predetermined time in the past, in which the movement information and the power consumption amount measurement value are associated with each other, thus making it possible to allow the persons present in the room to recognize a consumption state of a power amount in the air conditioner 100, which corresponds to the movement of the persons concerned present in the room.

[Operations of Energy Consumption Management System 2]

Figure 6:
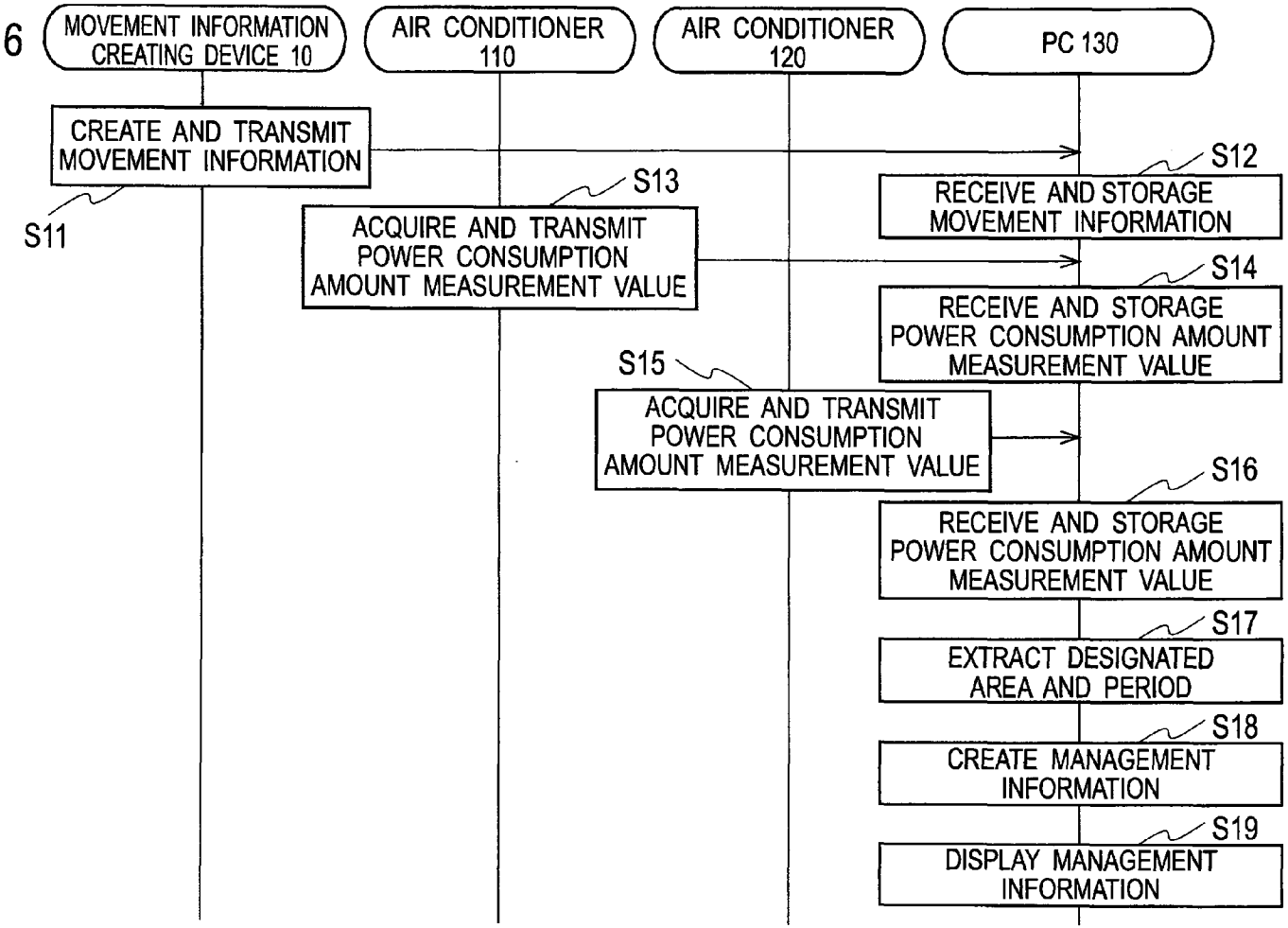
FIG. 6 is a sequence chart showing an operation in the configuration example (2) of the energy consumption management system according to the first embodiment.

With reference to a sequence chart of FIG. 6, a description is made of operations performed when the energy consumption management processing is executed in the energy consumption management system 2 shown in FIG. 3.

First, the movement information regarding the persons present in the room is created at a predetermined time interval by the movement information creating device 10 in the room Y as the management target area, and is then transmitted to the PC 130 through the dedicated transmission line 140 (S11).

Here, image information in which the management target area Y is imaged by a camera device (not shown) is analyzed by the movement information creating device 10, whereby the number of persons present in the room and the activity amount thereof are measured, and measurement values thus obtained are created as the movement information.

In the accumulating device 30 of the PC 130, the movement information transmitted from the movement information creating device 10 is acquired by the movement information acquiring unit 31, and is stored in the acquired information storage unit 33 (S12).

Moreover, by the power consumption amount measuring device 20 built in the air conditioner 110, the power consumption amount measurement value transmitted from the air conditioner 110 is acquired at a predetermined time interval, and is transmitted to the PC 130 through the dedicated transmission line 140 (S13).

In the accumulating device 30 of the PC 130, the power consumption amount measurement value transmitted from the air conditioner 110 is acquired by the power consumption amount measurement value acquiring unit 32, and is stored in the acquired information storage unit 33 (S14).

Moreover, by the power consumption amount measuring device 20 built in the air conditioner 120, the power consumption amount measurement value of the air conditioner 120 is acquired at a predetermined time interval, and is transmitted to the PC 130 through the dedicated transmission line 140 (S15).

In the accumulating device 30 built in the PC 130, the power consumption amount measurement value transmitted from the air conditioner 120 is acquired by the power consumption amount measurement value acquiring unit 32, and is stored in the acquired information storage unit 33 (S16).

Then, based on the information regarding the set display target area and display target period, the movement information and the power consumption amount measurement value, which correspond to the area concerned and the period concerned, are extracted from the acquired information storage unit 33 (S17), and the management information, in which the movement information and the power consumption amount measurement value, both being accumulated at a predetermined time interval (for example, 10 minutes), are associated with each other, is created in the management information creating unit 34 (S18). Here, it is assumed that the room Y is set as the display target area, and that, for example, 1 hour in the past before a current time as a start point is set as the display target period.

Then, the management information created in the management information creating unit 34 is displayed on the display device 40 (S19).

As described above, the display device 40 in the PC 130 in the management target area is allowed to display the management information during the predetermined time in the past, in which the movement information and the power consumption amount measurement value are associated with each other, thus making it possible to allow the persons present in the room to recognize a consumption state of a power amount in each of the air conditioners 110 and 120, which corresponds to the movement of the persons concerned present in the room.

[Operations of Energy Consumption Management System 3]

Figure 7:
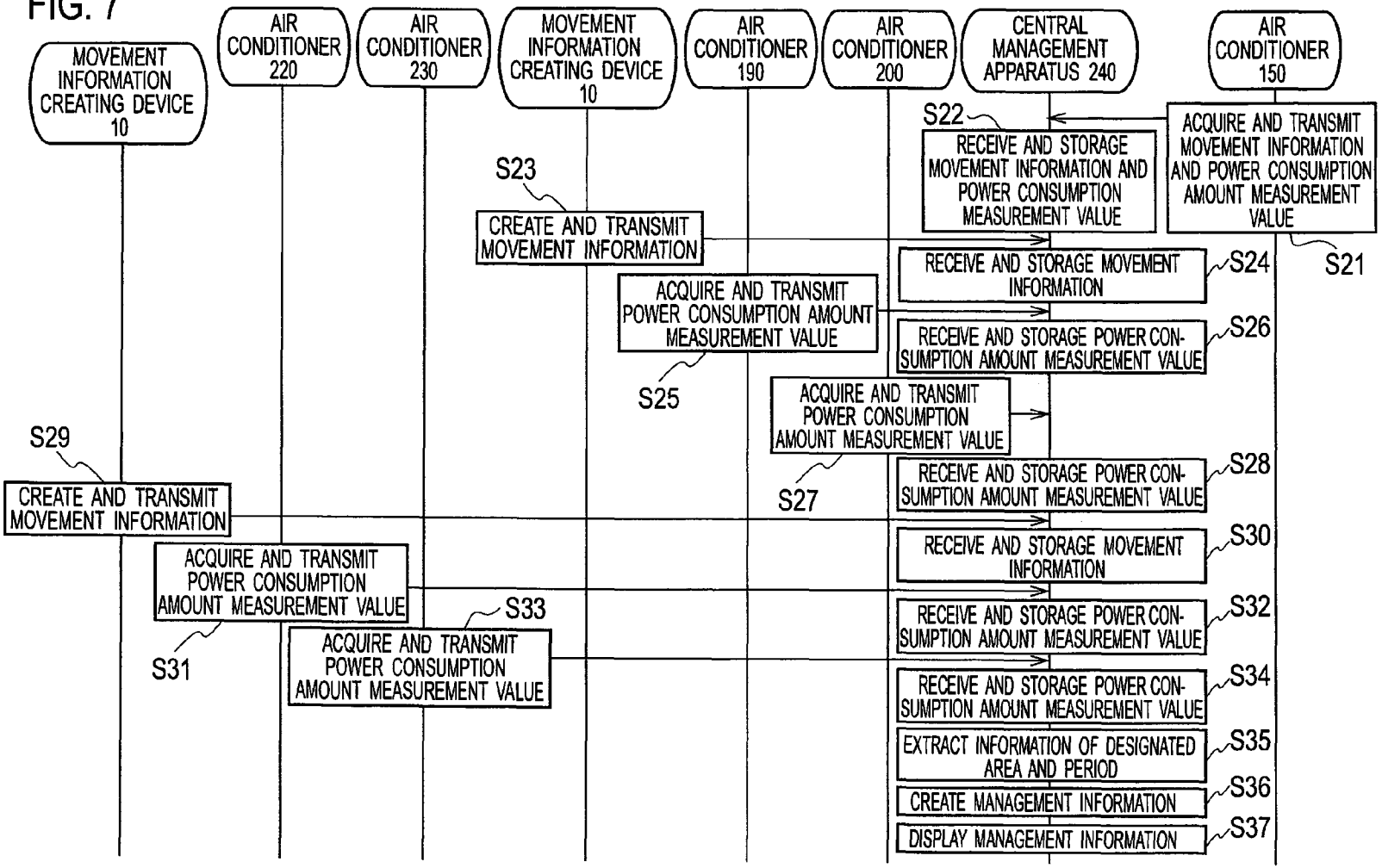
FIG. 7 is a sequence chart showing an operation in the configuration example (3) of the energy consumption management system according to the first embodiment.

With reference to a sequence chart of FIG. 7, a description is made of operations performed when the energy consumption management processing is executed in the energy consumption management system 3 shown in FIG. 4.

First, in the movement information creating device 10 built in the air conditioner 150 in the room A as the management target area, the movement information regarding the persons in the room is created at a predetermined time interval.

Here, image information in which the management target area A is imaged by a camera device (not shown) is analyzed by the movement information creating device 10, whereby the number of persons present in the room and the activity amount thereof are measured, and measurement values thus obtained are created as the movement information.

Moreover, in the power consumption amount measuring device 20 built in the air conditioner 150, the power consumption amount accumulated at a predetermined time interval is measured.

The created movement information is transmitted from the air conditioner 150 through the wireless network 160, the wireless base station 170 and the Internet 180 to the center management apparatus 240 (S21).

In the center management apparatus 240, the movement information transmitted from the air conditioner 150 is acquired by the movement information acquiring unit 31 of the accumulating device 30, and in addition, the power consumption amount measurement value is acquired by the power consumption amount measurement value acquiring unit 32, and is stored in the acquired information storage unit 33 (S22).

Moreover, in the movement information creating device 10 in the room B as the management target area, the movement information regarding the persons present in the room is created at a predetermined time interval, and is transmitted to the center management apparatus 240 through the wired network 210 and the Internet 180 (S23).

In the center management apparatus 240, the movement information transmitted from the movement information creating device 10 in the room B is acquired by the movement information acquiring unit 31 of the accumulating device 30, and is stored in the acquired information storage unit 33 (S24).

Moreover, by the power consumption amount measuring device 20 built in the air conditioner 190 in the room B, the power consumption amount measurement value of the air conditioner 190 concerned is acquired at a predetermined time interval, and is transmitted to the center management apparatus 240 through the wired network 210 and the Internet 180 (S25).

In the center management apparatus 240, the power consumption amount measurement value transmitted from the air conditioner 190 is acquired by the power consumption amount measurement value acquiring unit 32 of the accumulating device 30, and is stored in the acquired information storage unit 33 (S26).

Furthermore, by the power consumption amount measuring device 20 built in the air conditioner 200 in the room B, the power consumption amount measurement value of the air conditioner 200 concerned is acquired at a predetermined time interval, and is transmitted to the center management apparatus 240 through the wired network 210 and the Internet 180 (S27).

In the center management apparatus 240, the power consumption amount measurement value transmitted from the air conditioner 200 is acquired by the power consumption amount measurement value acquiring unit 32 of the accumulating device 30, and is stored in the acquired information storage unit 33 (S28).

Moreover, in the movement information creating device 10 in the room C as the management target area, the movement information regarding the persons present in the room is acquired at a predetermined time interval, and is transmitted to the center management apparatus 240 through the wired network 210 and the Internet 180 (S29).

In the center management apparatus 240, the movement information transmitted from the movement information creating device 10 in the room C is acquired by the movement information acquiring unit 31 of the accumulating device 30, and is stored in the acquired information storage unit 33 (S30).

Moreover, by the power consumption amount measuring device 20 built in the air conditioner 220 in the room C, the power consumption amount measurement value of the air conditioner 220 concerned is acquired at a predetermined time interval, and is transmitted to the center management apparatus 240 through the wired network 210 and the Internet 180 (S31).

In the center management apparatus 240, the power consumption amount measurement value transmitted from the air conditioner 220 is acquired by the power consumption amount measurement value acquiring unit 32 of the accumulating device 30, and is stored in the acquired information storage unit 33 (S32).

Moreover, by the power consumption amount measuring device 20 built in the air conditioner 230 in the room C, the power consumption amount measurement value of the air conditioner 230 concerned is acquired at a predetermined time interval, and is transmitted to the center management apparatus 240 through the wired network 210 and the Internet 180 (S33).

In the center management apparatus 240, the power consumption amount measurement value transmitted from the air conditioner 220 is acquired by the power consumption amount measurement value acquiring unit 32 of the accumulating device 30, and is stored in the acquired information storage unit 33 (S34).

Then, based on the information regarding the set display target area and display target period, the movement information and the power consumption amount measurement value, which correspond to the area concerned and the period concerned, are extracted from the acquired information storage unit 33 (S35), and the management information, in which the movement information and the power consumption amount measurement value, both being accumulated at a predetermined time interval (for example, 1 minute), are associated with each other, is created in the management information creating unit 34 of the accumulating device 30 (S36). Here, it is assumed that the rooms A to C are set as the display target areas, and that, for example, 20 minutes in the past before a current time as a start point is set as the display target period.

Then, the management information created in the management information creating unit 34 is displayed on the display device 40 (S37).

Here, on the portable terminal 250 connectable to the Internet 180, the management information created in Step S36 may be displayed.

In the above-mentioned processing, the following configuration may also be adopted, in which, at the time when the management information is created in the management information creating unit 34 of the accumulating device 30, a power consumption amount per person present in the room at a predetermined time interval is calculated in advance from the acquired movement information and power consumption amount measurement value, whereby management information is created, in which the movement information, the power consumption amount measurement value and the power consumption amount per person at the predetermined time interval are associated with one another, and the management information concerned is displayed on the display device 40.

FIG. 8 shows an example where the management information, in which the movement information, the power consumption amount measurement value and the power consumption amount per person at the predetermined time interval are associated with one another as described above, is displayed on the display device 40.

Figures 8A, 8B, 9:
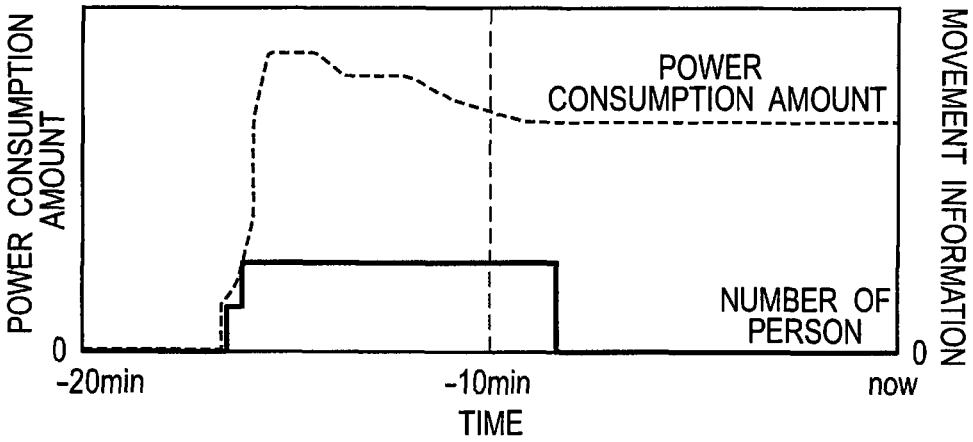
FIG. 8A is a table showing an example of management information displayed by the energy consumption management system according to the first embodiment.
FIG. 8B is a graph showing an example of management information displayed by the energy consumption management system according to the first embodiment.
FIG. 9 is a chart showing an example of management information displayed by the energy consumption management system according to the second embodiment.

FIGS. 8A and 8B are views showing management information created in the accumulating device 30 in such a manner that the movement information is acquired at a 1-minute interval from the movement information creating device 10 in each of the rooms, and that the power consumption amount measurement value is acquired at 1-minute interval from the power consumption amount measuring device 20 in each of the rooms: FIG. 8A is view showing latest management information in a table format; and FIG. 8B is a view showing a transition of the management information during 20 minutes in the past in a graph format.

Based on the latest management information, FIG. 8A shows that, in the room A, there are 15 (persons) present therein, an activity amount of the persons is 2 (met), a power consumption amount is 10 (kW), and a power consumption amount per person is 0.7 (kW), in the room B, there is 1 (person) present therein, an activity amount of the person is 1 (met), a power consumption amount is 9 (kW), and a power consumption amount per person is 9.0 (kW), and in the room C, there are 7 (persons) present therein, an activity amount of the persons is 2 (met), a power consumption amount is 11 (kW), and a power consumption amount per person is 1.6 (kW).

In accordance with the management information shown in the table format in FIG. 8A, it is understood that, in the room B, electric power is consumed more than in other areas though only one person whose activity amount is small is present therein.

Moreover, based on the management information during 20 minutes in the past, FIG. 8B shows, for example, a transition of the number (n) of persons in the room A and a transition of the power consumption amount (m), which are plotted in the graph format.

In accordance with the management information shown in the graph format in FIG. 8B, the power consumption amount is left high though the number of persons present in the room A became zero approximately 8 minutes ago. Accordingly, it is estimated that a stop operation for the air conditioner is not performed in the room where there is no person.

In accordance with the above-described embodiment, the movement information regarding the persons present in the room as the management target area and the energy consumption therein are displayed in association with each other, whereby information for performing suitable energy management can be provided to the persons present in the room and a manager, and the energy saving control operation can be assisted.

Moreover, the management information is displayed in the table format and the graph format, whereby it becomes easy for the system user who visually recognizes the display device 40 to understand the management information, and the energy saving control can be assisted more suitably. Furthermore, the power consumption amount per person is displayed for each of the rooms as the management target areas, whereby the power consumption amount can be compared relatively with those of the other areas and rooms, and the energy saving control operation by the system user can be further assisted.

(Second Embodiment)

<Configuration of Energy Consumption Management System According to Second Embodiment>

A configuration of an energy consumption management system according to a second embodiment of the present invention is similar to that of the energy consumption management system according to the first embodiment. Accordingly, a detailed description of devices and functional portions, which have the same functions, is omitted.

A movement information creating device 10 according to this embodiment creates movement information regarding persons present in a room as described in the first embodiment by using image information imaged by a camera device, and in addition, creates, as environment information, an opening degree of blinds, a window or the like in a window portion in a management target area from this image information, and transmits the created movement information and environment information to an accumulating device 30.

In the accumulating device 30, at the time when the management information is created, the environment information regarding an area concerned and a period concerned is also acquired together with the movement information and a power consumption amount measurement value, and the management information is created based on these.

<Operation of Energy Consumption Management System According to Second Embodiment>

In the energy consumption management system according to this embodiment, the above-mentioned environment information is created in the movement information creating device 10 in addition to the movement information regarding the persons in the room, and is then stored in the accumulating device 30 in advance, and in the management information creating unit 34, the management information is created based on the movement information, the power consumption amount measurement value and the environment information, which correspond to the display target area and the period. Other than the above, operations of the energy consumption management system according to this embodiment are similar to the operations of the energy consumption management system according to the first embodiment. Accordingly, a detailed description thereof is omitted.

FIG. 9 shows an example of the management information displayed on a display device 40 by the energy consumption management system according to this embodiment.

FIG. 9 is a view showing, in a table format, latest management information in the management information created in such a manner that the movement information and the environment information are acquired at a 1-minute interval from the movement information creating device 10 of each of the rooms, and that the power consumption amount measurement value is acquired at a 1-minute interval from the power consumption amount measuring device 20 of each of the rooms.

Based on the latest environment information and the like, FIG. 9 shows that, in the room A, there are 15 (persons) present therein, an activity amount of the persons is 2 (met), a power consumption amount is 10 (kW), an opening degree of the blinds is 0(%), and a power consumption amount per person is 0.7 (kW), in the room B, there is 1 (person) present therein, an activity amount of the person is 1 (met), and a power consumption amount is 9 (kW), an opening degree of the blinds is 80(%), and a power consumption amount per person is 9.0 (kW), and in the room C, there are 7 (persons) present therein, an activity amount of the persons is 2 (met), a power consumption amount is 11 (kW), an opening degree of the blinds is 100(%), and a power consumption amount per person is 1.6 (kW).

In accordance with the management information shown in the table format in FIG. 9, it is thought that, in the room B and the room C, the opening degrees of the blinds are high, resulting in a decrease of air conditioning efficiency.

In accordance with this embodiment described above, in addition to the movement information regarding the persons present in the room as the management target area and the energy consumption therein, the environment information indicating the opening degree of the blinds or the window is displayed in association therewith, whereby information for performing suitable energy management can be provided to the persons present in the room and the manager, and the energy saving control operation can be further assisted.

(Other Embodiments)

Moreover, as another embodiment, a configuration may be adopted so that, between the movement information creating device 10 and the power consumption amount measuring device 20 in the energy consumption management system, a device set as a creation target of the management information by acquiring the information therefrom by the accumulating device 30 can be set in a changeable state by the system user.

Figure 10:
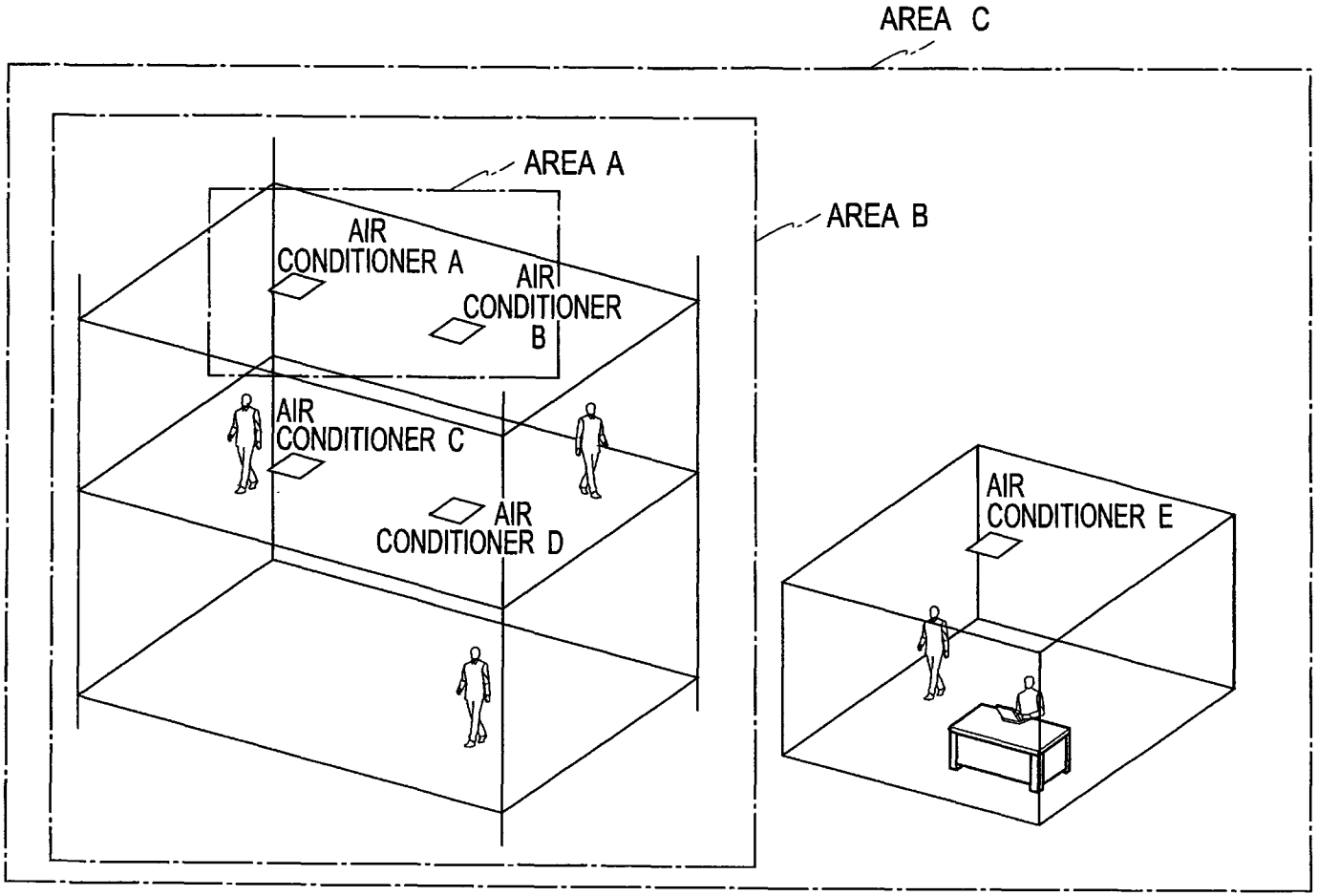
FIG. 10 is an illustration diagram showing various management target areas of the energy consumption management system according to other embodiment.

With such a configuration, the device desired to be set as the target of the energy saving management can be changed in response to the purpose, and can be set as the creation target of the management information. As shown in FIG. 10, the purpose includes the case where the energy consumption is desired to be managed per floor (for example, an area A), the case where the energy consumption is desired to be managed per building (for example, an area B), the case where the energy consumption is desired to be managed per region including a plurality of buildings (for example, an area C), the case where the energy consumption is desired to be managed by instrument or per air conditioning control area, and the like.

Moreover, as another embodiment, a configuration may also be adopted so that a period while the information is being accumulated from the movement information creating device 10 and the power consumption amount measuring device 20 in the accumulating device 30 can be set in a changeable state by the system user.

With such a configuration, such a period desired to be set as the target of the energy saving management can be changed in response to the purpose, and can be set as the creation target of the management information. Here, the purpose includes the case where information at a certain moment or for a short period is necessary, for example, the case where latest management information or the management information during 1 hour in the past is desired to be displayed, and the case where information in a long span is necessary, for example, the case where the management information during 1 year in the past or the management information in the last year is desired to be displayed, and the like.

Furthermore, as another embodiment, a configuration may also be adopted so that, in the management information creating unit 34 of the accumulating device 30, there can be held in advance text information with contents to urge the energy saving control operation, for example, text information with contents to recommend to raise a setting temperature of the air conditioner and text information with contents to recommend to close the blinds and the window, and a threshold value for presenting these pieces of text information, for example, a threshold value per person and a threshold value of the opening degree of the blinds, and by using these pieces of information and these values, the corresponding text information can be contained at the time when the management information is created.

For example, in the case where the created power consumption amount per person is equal to or more than the held threshold value, management information containing text information with contents to recommend to raise the setting temperature of the air conditioner is created, and moreover, in the case where the opening degree of the blinds is equal to or more than the held threshold value, management information containing text information with contents to recommend to close the blinds is created, and these pieces of information are displayed on the display device 40. In such a way, the persons present in the room and the manager, who have visually recognized the display device 40, can be specifically urged to perform the energy saving control operation.

Moreover, in the management information creating unit 34, there is held in advance text information with contents to attract attention so as to stop the air conditioner, and in the case where it is determined that there are no persons in the room based on the movement information acquired from the movement information creating device 10, management information containing this text information is created, and is displayed on the display device 40. In such a way, the energy saving control operation can be further urged.

Furthermore, in the management information creating unit 34, there is held in advance text information with contents to recommend to change the room (area) for use. Then, in the case where the energy consumption with respect to the number of persons and the activity amount is higher than a preset threshold value in a certain short period, and in the case where the air conditioner is intermittently operated and consumes the energy wastefully though the activity amount is steadily smaller than a predetermined value as a result of analyzing the management information for a long period (for example, a period per month or per year), then management information containing text information for guiding persons to gather to a small number (for example, one) of rooms (areas) is created, and is displayed on the display device 40. In such a way, the energy saving control operation to stop the air conditioner of the rooms concerned can be urged.

Moreover, an area and the number of accommodations for each of rooms (areas) are preset, or alternatively, the average number of using persons is calculated based on the management information of the long period. In the case where the energy consumption is large though the number of using persons at a certain point of time is small with respect to the number of accommodations and the average number of using persons, the persons concerned are urged to move to a room (area) where the number of accommodations and the average number of using persons are small and energy efficiency is increased, whereby the energy consumption as a whole can be suppressed.

Furthermore, in the management information creating unit 34, in combination with the management information containing the text information for executing the energy saving control operations as described above, information regarding an energy saving effect expected to be obtained when these energy saving control operations are executed, for example, an estimated reduction amount of the power consumption amount is calculated and displayed. In such a way, consciousness of the persons present in the room and the manager to the energy saving control operations can be enhanced.

Moreover, the management information is accumulated for each period set by the system user, for example, per week, per month and the like, and by using a table, a graph and text information, a report is automatically created, and is presented to the system user, whereby the energy saving effect can be periodically confirmed, and measures for saving the energy can be examined periodically, and so on.

Furthermore, the following configuration may also be adopted. The above-mentioned accumulating device 30 is connected to a control device that controls an instrument such as the air conditioner in the management target area. In the case where it is determined it is necessary to reduce the power consumption amount, the case including a case where an energy saving control request is acquired from the outside (for example, a power company), and a case where it is detected that the power consumption amount has exceeded a preset power consumption amount, then from the management information creating unit 34 to the control device concerned, there may be sent out an instrument stop instruction to stop an instrument in which the power consumption amount is larger with respect to the movement information regarding the persons present in the room, for example, an instrument in which the power consumption amount per person is large.

Moreover, in each of the above-mentioned embodiments, the description has been made of the case where the power consumption amount of the air conditioner is measured as the power consumption amount of the instrument in the management target area; however, without being limited to this, for example, a power consumption amount from a lighting apparatus and an outlet in the management target area may be measured, and management information may be created therefrom. At this time, it is considered that, in the case where it is determined that the measured power consumption amount is extraordinarily high, setting is made so that text information to urge the system user to pay attention thereto can be displayed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An energy consumption management system comprising:

a movement information creating device creating movement information regarding a person in a management target area at a predetermined time interval;

a power consumption amount measuring device measuring a power consumption amount of an instrument in the management target area at a predetermined time interval;

an accumulating device creating management information in which the movement information created by the movement information creating device is associated with a power consumption amount measurement value measured by the power consumption amount measuring device; and a display device displaying the management information created by the accumulating device, wherein the movement information creating device creates information regarding a number of persons present in a room as the movement information, and the accumulating device calculates a power consumption amount per person present in the room from the acquired movement information and power consumption amount measurement value, and the display device displays the power consumption amount per person.

2. The system according to claim 1, wherein the accumulating device acquires the movement information created by the movement information creating device and the power consumption amount measurement value measured by the power consumption amount measuring device, stores the acquired movement information and power consumption amount measurement value individually together with time information, extracts movement information corresponding to set display target period information and a power consumption amount measurement value corresponding thereto from the stored information, and creates management information in which the movement information and the power consumption amount measurement value are associated with each other at a predetermined time interval.

3. The system according to claim 2, further comprising:

means for changing the display target period information.

4. The system according to claim 1, wherein the accumulating device acquires the movement information created by the movement information creating device and the power consumption amount measurement value measured by the power consumption amount measuring device, stores the acquired movement information and power consumption amount measurement value individually together with time information, extracts movement information having position information corresponding to set display target area information and a power consumption amount measurement value corresponding thereto from the stored information, and creates management information in which the movement information and the power consumption amount measurement value are associated with each other at a predetermined time interval.

5. The system according to claim 4, further comprising:

means for changing the display target area information per instrument, per control area by the instrument, per floor in a building, per building or per region.

6. The system according to claim 1, wherein the movement information creating device further creates environment information indicating information regarding an opening degree of blinds of a window in the management target area or an opening degree of the window at a predetermined time interval, and the display device displays the environment information.

7. The system according to claim 1, wherein the accumulating device creates the management information so as to display the management information in a table format or a graph format.

8. The system according to claim 1, wherein the accumulating device holds in advance text information with contents to urge an energy saving control operation, and contains the text information in the created management information when information contained in the management information satisfies a predetermined condition.

9. The system according to claim 1, wherein the system is connected to a control device that controls an instrument in the management target area, and the accumulating device sends out an instrument stop instruction to stop an instrument in which the power consumption amount is larger with respect to the movement information to the control device, when it is determined to be necessary to reduce the power consumption amount.

10. An energy consumption management apparatus connectable to a movement information creating device creating movement information regarding a person in a management target area at a predetermined time interval, and to a power consumption amount measuring device measuring a power consumption amount of an instrument in the management target area at a predetermined time interval, the system comprising:

a movement information acquiring unit acquiring the movement information created by the movement information creating device when the movement information acquiring unit is connected to the movement information creating device;

a power consumption amount measurement value acquiring unit acquiring a power consumption amount measurement value measured by the power consumption amount measuring device when the power consumption mount measurement value acquiring unit is connected to the power consumption amount measuring device; and a management information creating unit creating management information in which the movement information acquired by the movement information acquiring unit is associated with the power consumption amount measurement value measured by the power consumption amount measuring unit, wherein the movement information acquiring unit acquires information regarding a number of persons present in a room as the movement information by the movement information creating device, and the management information creating unit calculates a power consumption amount per person present in the room from the acquired movement information and power consumption amount measurement value.

* * * * *